US009938768B2

(12) United States Patent
Carlsson

(10) Patent No.: US 9,938,768 B2
(45) Date of Patent: Apr. 10, 2018

(54) DEVICE AND SYSTEM FOR PERCUSSION ROCK DRILLING

(71) Applicant: ATLAS COPCO SECOROC AB, Fagersta (SE)

(72) Inventor: Jimmy Carlsson, Fagersta (SE)

(73) Assignee: Epiroc Drilling Tools Aktiebolag, Fagersta (SE)

( * ) Notice: Subject to any disclaimer, the term of this patent is extended or adjusted under 35 U.S.C. 154(b) by 164 days.

(21) Appl. No.: 14/785,383

(22) PCT Filed: May 16, 2014

(86) PCT No.: PCT/SE2014/050599
§ 371 (c)(1),
(2) Date: Oct. 19, 2015

(87) PCT Pub. No.: WO2014/185855
PCT Pub. Date: Nov. 20, 2014

(65) Prior Publication Data

US 2016/0069134 A1 Mar. 10, 2016

(30) Foreign Application Priority Data

May 17, 2013 (SE) ..... 1350606

(51) Int. Cl.
*E21B 1/00* (2006.01)
*E21B 4/14* (2006.01)
(Continued)

(52) U.S. Cl.
CPC ..... *E21B 1/00* (2013.01); *E21B 4/06* (2013.01); *E21B 4/14* (2013.01); *E21B 10/36* (2013.01);
(Continued)

(58) Field of Classification Search
CPC combination set(s) only.
See application file for complete search history.

(56) References Cited

U.S. PATENT DOCUMENTS 4,094,364 A 6/1978 Lundstrom et al.
4,241,800 A 12/1980 Stenuick
(Continued)

FOREIGN PATENT DOCUMENTS

AU 2006203631 A1 3/2007
CN 2568795 Y 8/2003
(Continued)

OTHER PUBLICATIONS

PCT/ISA/210—International Search Report—dated Feb. 20, 2015 (Issued in Application No. PCT/SE2014/050599).
(Continued)

*Primary Examiner* — Kyle Armstrong
(74) *Attorney, Agent, or Firm* — Venable LLP; Jeffri A. Kaminski

(57) ABSTRACT

A drill bit for percussion rock drilling. An impact portion includes an impact surface for striking against rock in an impact direction. An engagement portion includes a holder configured to hold the drill bit axially in a drill head of a drill string, and a rotation engagement member configured to connect the drill bit with the drill head for rotating the drill bit. An anvil surface is directed opposite to the impact direction for receiving shock waves from a striker rod of the drill string. A flushing channel is configured to transfer flushing fluid to the impact surface. The holder and the anvil surface are inside a holder recess having an opening that is directed opposite to the impact direction. Also a drill string component, a system and a method.

26 Claims, 6 Drawing Sheets

(51) Int. Cl.

| | |
|---|---|
| ***E21B 4/06*** | (2006.01) |
| ***E21B 10/36*** | (2006.01) |
| ***E21B 17/03*** | (2006.01) |
| ***E21B 10/38*** | (2006.01) |
| ***E21B 17/22*** | (2006.01) |

(52) U.S. Cl.
CPC ..... *E21B 10/38* (2013.01); *E21B 17/03* (2013.01); *E21B 17/22* (2013.01)

(56) References Cited

U.S. PATENT DOCUMENTS

| | | | | |
|---|---|---|---|---|
| 4,323,128 | A | 4/1982 | Young | |
| 4,805,705 | A | 2/1989 | Liljebrand et al. | |
| 4,862,976 | A | 9/1989 | Meek | |
| 5,038,874 | A * | 8/1991 | Larsson | E21B 10/38 173/126 |
| 5,125,464 | A * | 6/1992 | Sabatier | E21B 6/00 175/135 |
| 6,029,757 | A * | 2/2000 | Anderson | E21B 1/02 173/202 |
| 6,148,934 | A * | 11/2000 | Borg | E21B 4/20 175/293 |
| 6,283,229 | B1 * | 9/2001 | Wentworth | E21B 4/06 173/11 |
| 6,454,025 | B1 * | 9/2002 | Runquist | E21B 4/14 175/61 |
| 6,516,899 | B2 * | 2/2003 | Wentworth | E21B 4/14 175/398 |
| 6,609,577 | B2 * | 8/2003 | Beccu | B25B 19/00 173/104 |
| 2001/0018990 | A1 | 9/2001 | Asberg et al. | |
| 2004/0188146 | A1 | 9/2004 | Egerstrom | |
| 2008/0078584 | A1 | 4/2008 | Lyon | |
| 2011/0209919 | A1 | 9/2011 | Aros | |

FOREIGN PATENT DOCUMENTS

| | | | |
|---|---|---|---|
| CN | 102859110 | A | 1/2013 |
| EP | 0383737 | A1 | 8/1990 |
| EP | 0387218 | A1 | 9/1990 |
| EP | 0486449 | A1 | 5/1992 |
| SE | 8802648 | L | 1/1990 |

OTHER PUBLICATIONS

PCT/ISA/237—Written Opinion of the International Searching Authority—dated Feb. 20, 2015 (Issued in Application No. PCT/SE2014/050599).

* cited by examiner

DEVICE AND SYSTEM FOR PERCUSSION ROCK DRILLING

CROSS-REFERENCE TO RELATED APPLICATIONS

The application claims priority to Swedish patent application 1350606-8 filed 17 May 2013 and is the national phase under 35 U.S.C. § 371 of PCT/SE2014/050599 filed 16 May 2014.

FIELD OF THE INVENTION

The invention relates to a drill bit for percussion rock drilling including an impact portion and an engagement portion. An anvil surface of the drill bit is directed opposite to the impact direction for receiving shock waves from a striker rod of the drill string.

The invention also relates to a drill string component, a system and a method for rock drilling.

BACKGROUND OF THE INVENTION

A system for percussion rock drilling is previously known, wherein the individual drill string component includes a striker rod that transmits stress wave or shock wave energy and feed force from the drill rig and the rock drilling machine (hammer) to the drill bit. Basically, in a drill string including a plurality of drill string components of the type intended here, the striker rods make contact with each other and the shock wave propagates through the lengths of the striker rods and over the contact surfaces between the striker rods.

The individual drill string component also includes a tube-shaped, rotation force transmitting unit having screw threads at each end for joining it to other drill string components. A most distal element of the drill string for receiving the drill bit is named drill head.

The striker rod is coaxial with and extends inside the tube-shaped unit. A limited relative axial movement is allowed between the striker rod and the tube-shaped unit allowing the minor necessary displacements of the striker rod in respect to the tube-shaped unit during propagation of the stress wave to be unrestricted. An important function of the drill string component is to allow transportation of flushing fluid which in this case normally is pressurized air together with suspended lubricant droplets.

The flushing fluid has the function to provide for removal of disintegrated rock and to provide lubrication between relatively moveable parts of the components of the system.

The previously known system functions well, and in comparison to commonly known older one-piece threaded drill string components, it offers better efficiency and reduced losses in transferring the stress wave from the hammer to the drill bit. The reason for this is that the stress wave is transferred between contact surfaces being essentially planar end surfaces on the striker rods as a contrast to threaded joints of the older components.

The present invention addresses issues regarding further development of the above drill hit such as possibility to provide increased working life of the different parts, enhanced economy and operational security.

A system according to the background art is marketed by the Applicant under the trade name "Coprod".

US2008/0078584 A1 describes a drill bit assembly for a down the hole hammer, wherein the bit has a plurality of axially extending bit lugs for co-operation with a corresponding plurality of axially extending chuck lugs on a holding chuck.

SUMMARY OF THE INVENTION

It is an aim of the invention to address the above mentioned issues and to present a further developed drill bit, a drill string component, a system and a method starting out from the background art.

This aim is obtained in a drill bit according to the above, in that the engagement portion includes a holder recess having an opening that is directed opposite to the impact direction, that the holder means are arranged inside the holder recess, that the holder means are directed inwards inside the holder recess for co-operation with corresponding holder elements on the striker rod, that the anvil surface is arranged inside the holder recess, and that the rotation engagement means are directed outwards for rotational force co-operation with corresponding elements protruding inwards inside a cavity of the drill head.

The drill bit can be said to form a cup and have a pipe-shaped or sleeve-shaped engagement portion extending from the impact portion with the cup opening in the direction of the hammer.

The holder means are on the inside of the sleeve-shaped engagement portion, are directed radially inwards inside the holder recess to form inside protrusions. The holder means are arranged to co-operate with corresponding holder elements on the striker rod. Hereby it has been made possible to use one single element—the striker rod—also for the function of providing axial holding support for the drill bit.

The rotation engagement means are on the outside of the sleeve portion and are protruding and facing outwards so as to be adapted for rotational force co-operation with corresponding elements protruding inwards inside a cavity of the drill head.

Since the anvil surface is inside the holder recess which is adapted to receive a striker rod, the anvil surface is closed and intact without any flushing channel. No fluid flows through the holder recess. Flushing fluid is instead guided outside the engagement portion.

Hereby it is possible to produce the drill bit shorter, seen axially, since it is made possible to avoid the requirement to arrange the holder means and the rotation engagement means axially separated or behind each other. Instead it has been made possible to arrange the holder means inwardly of the rotation engagement means. This is a great advantage because the drill bit can be produced relatively smaller and thereby less expensive than drill bits according to the background art. It also renders the requirements regarding support of the drill bit at the region of the most distal part of the drill head less rigorous, i.a. making a previously used support bushing in that region unnecessary or at least with less strict requirements.

The drill bit is essentially rotational symmetrical around a symmetry axis also basically being a symmetry axis for the other components of the drill string. Certain parts of the drill bit such as buttons on the impact surface are not necessarily positioned symmetrically in respect of the symmetry axis.

It is preferred that the anvil surface, which is essentially perpendicular to the symmetry axis, is a bottom surface inside the holder recess. It is, however not excluded that the anvil surface is arranged on a protrusion or with a central hole inside the recess.

It should be noted that "anvil surface" is used for a surface of the drill bit being adapted to co-operate with a striker rod for receiving shock waves propagating through the lengths of all the striker rods of the drill string. The shock waves thus have propagated over the lengths of all striker rods and over the contact surfaces between all striker rods and subsequently over the contact surfaces between the most distal (as seen from the drill rig) striker rod and the anvil surface of the drill bit. With "anvil surface", here is thus basically intended a surface of the drill bit for receiving shock waves from a striker rod.

Also suitably the holder means are arranged to allow limited axial movement of the drill bit in respect of the drill head.

The holder means are preferably female screw threads for the co-operation with male screw threads comprising the holder elements. This makes it possible, in an effective way, to use the facility for subjecting the drill string to rotation for establishing the engagement between the striker rod and the drill bit. It is, however, within the scope of the invention and possible to use other means such as e.g. bayonet joint element or similar for the connection between the striker rod and the drill bit.

When the holder recess has an innermost portion, in front of the holder means as seen along the symmetry axis in the impact direction, said innermost portion being free from holder means, it is achieved that during operation, the striker rod can move freely, within limitations, when the striker rod is in the operational position. This allows limited axial movement of the striker rod in respect of the drill bit in its operating position.

It is most preferred that the drill hit includes flushing channel means for flow of flushing fluid to the impact surface, that the flushing channel means is comprised of a first and a second section, that in the first section, the flushing channel means extends outside the engagement portion, and that, in the second section, the flushing channel means extends from the engagement portion to a central region of the impact surface, whereby, in operation of the drill bit, the flushing fluid is arranged to flow between surfaces limiting the drill bit in said first section and adjacent surfaces limiting the drill head.

This means that the flushing channel means extends external of a surface or surfaces limiting the engagement portion means for forming, in operation, a flow path for the entire flushing fluid flow between surface limitations of the drill bit in the first section and adjacent surface limitations of the drill head in a mounted position of the drill bit inside the drill head. The drill bit is thus made free from any channel in the form of through bores or the like for flushing fluid flow in the first section.

Hereby it is achieved that the entire flushing fluid flow passes through or at least adjacent to the rotation engagement means. It is made possible to enhance lubrication and cooling of the rotation engagement means, which are normally ridge-spline-like elements since the flushing channel means extends outside of the surface or surfaces limiting the ridge-spline-like elements and external of the surface or surfaces limiting the guiding areas of the drill head because of the fact that all of the flushing fluid passes this way according to this aspect of the invention.

These parts of the system have proven to be most important parts to lubricate, since heat is produced here because of the torque that is transferred during operation, and since, in general terms, the lubrication reduces wear.

The enhanced lubrication and cooling offered through this aspect of the invention makes it possible for created heat to quickly dissipated whereby harmful influences on the structural integrity of the material in the rotation engagement means can be avoided. Since, according to the background art, the major portion of the flushing fluid with added lubricants is passed centrally through the drill bit, the invention provides a clear improvement since it enhances both lubrication and cooling of these relatively sensitive machine parts.

Advantageously, the flushing channel means, in the first section, extends in deepened grooves (forming splines or similar) between a plurality of axially extending ridges at the outside of the engagement portion, said ridges comprising the rotation engagement means, for realizing enhanced flushing fluid flow. Flushing fluid then flows in these deepened grooves inside inner surfaces on inward ridges formed on the inside of the drill head. As alternatives, the number of ridges in one of the drill bit and the drill head can be less than the number of grooves whereby flushing fluid can be allowed to flow in grooves not being occupied by a ridge.

It is preferred that the flushing channel means, in the second section, extends from a space outside the drill bit towards the impact surface, said space being a flushing fluid equalizing and distributing chamber in a mounted position in the drill head of the drill bit. This measure reduces tendencies of uneven flushing fluid flow to the impact surface. It also gives greater freedom to design the flushing channel means in the first as well as in the second section according to particular conditions prevailing at the respective section. The reason for this is that the flushing fluid flow, when coming from the first section, is allowed to be balanced in the flushing fluid equalizing and distributing chamber before entering the second section. Hereby the flow in the second section will be enhanced.

Suitably, the flushing channel means, in the second section, is one from the group: at least one bore through the impact portion, at least one groove in a surface of the impact portion. Also suitably, the flushing channel means, in the second section, extends from the equalizing and distributing chamber to a central region of the impact surface.

Preferably the drill bit includes axially separated upper and lower guide areas for co-operation with the drill head for stability reasons. Suitably, the lower guide areas is a circular cylindrical surface portion adjacent to the impact portion and upper guide areas are slightly protruding part circular cylindrical portions of the ridges comprising the rotation engagement means. Both guide areas are arranged to co-operate with corresponding guide means on the drill head.

The invention also relates to an inventive drill string component for positioning between a percussive rock drilling machine and a drill bit, the drill string component including:

- a tube-shaped, rotation force transmitting unit having screw threads at each end for joining to other drill string components, and
- a striker rod for transmitting feed force and shock waves to the drill bit and being coaxial with and extending inside the tube-shaped unit, wherein a flushing fluid flow channel is formed inside the tube-shaped unit. The inventive drill string component is distinguished in that the tube-shaped unit includes means for rotational co-operation with rotation engagement elements of the striker rod.

This makes it possible to rotate the striker rod by rotating the drill string component. Hereby it is made possible to establish the engagement between the striker rod and the drill bit as is described above. Advantages corresponding to what is described above are obtained.

When all components in a drill string have this feature, it is i.a. not necessary for the operator to distinguish between a specific "end component" to be positioned closest to the drill bit.

Preferably, the tube-shaped unit mainly includes a central tubular part which is friction-welded for permanent connection to an upper (closest to the hammer) threaded end part as well as to a lower (closest to the drill bit) threaded end part. An additional threaded end part is connected by means of a threaded connection to the lower threaded end part to complete what can be said to be an ordinary drill string component having threads at each end mating threads on other ordinary drill string components. The additional threaded end part prevents the striker rod from escaping from the tube-shaped unit.

Closest to the drill bit, the additional threaded end part of the ordinary drill string component is advantageously replaced by a drill string end part being a drill head for receiving the drill bit. In an advantageous aspect of the invention, the drill head, at its end part facing away from the drill bit is thus equipped with a thread that corresponds to the one on the lower threaded end part. Hereby the central tubular part can be joined with the drill head over the lower threaded end part. Further, the drill head and the drill bit are preferably dimensioned such that the ordinary striker rod, being part of the drill string component, can be directly used for action against the anvil surface of the drill bit.

This aspect of the invention creates modularity and reduces the number of different elements required for a complete drill string system.

It is, however, also in some situations advantageous to construct a specific drill head end component with a particularly dimensioned striker rod. The reason for this is that this makes it possible to optimize the length of the most distal striker rod for best stress wave transfer properties.

Suitably there are rotation inducing means formed in the tube-shaped unit, being a combination of axially extending inward ridges and grooves, for rotational co-operation with rotation engagement elements of the striker rod.

Preferably the rotation engagement elements of the striker rod are radially extending wings engaging the rotation inducing means of the tube-shaped unit.

It is important to realize that there is arranged for flushing fluid flow in a flushing fluid flow channel being formed through the drill string component such that this channel also extends between the rotation inducing means and the rotation engagement elements of the striker rod.

Advantageously, the flushing fluid flow channel is formed between the tube-shaped unit and the striker rod, in particular between the co-operating wings as and ridges.

When the drill string component includes a drill head for holding the drill bit instead of the additional threaded end part, the tube-shaped unit includes means for rotational co-operation with rotation engagement means of the drill bit as is described above, upper and lower guide means for respective co-operation with the upper and lower guide areas of the drill bit. The striker rod is held axially in respect of the drill string component and is arranged to be directly active against the anvil surface of the drill bit.

The holder elements are advantageously directed outwards. It is preferred that the holder elements are male screw threads for the co-operation with female screw threads on the drill bit. See the above discussion.

The invention also relates to a drill string system for percussion rock drilling including an inventive drill bit according to the above, and at least one inventive drill string component according to the above.

Advantageously, the flushing fluid flow channels are formed in spaces formed between the drill bit and the drill head in the region of the rotation engagement means.

The tube-formed flex unit preferably includes two telescopically displaceable, mutually rotationally locked parts allowing an axial length compensation for shock wave-induced shortenings of striker rods in the drill string relative to tube-shaped units in the drill string over time. The flex unit is typically placed in the drill string close to the rock drilling machine and also compensates for differences in manufacturing tolerances of the lengths of the tube-shaped units and the striker rods.

It is highly preferred for energy efficiency reasons that the sum of a length of the drill bit from the impact surface to the anvil surface and a length of a striker rod being in contact with the drill bit is equal to or is slightly longer than half the wave-length of said shock waves. With rock drilling machines having suitable hammer design, said sum of drill bit length and "end" striker rod (being closest to the drill bit) length is advantageously 300-2000 mm and more preferred 700-900 mm.

In an inventive method for rock drilling, wherein a drill bit strikes with an impact surface against rock in an impact direction, and flushing fluid is transferred through a drill string to the impact surface, flushing fluid is made to flow in flushing fluid flow channels that are formed between the drill bit and the drill head in the region of the rotation engagement means, wherein the flushing fluid, in a second section, flows from a space outside the drill bit being a flushing fluid equalizing and distributing chamber in a mounted position of the drill bit towards the impact surface.

BRIEF DESCRIPTION OF THE DRAWINGS

The invention will now be described in greater detail at the background of embodiments and with reference to the annexed drawings, wherein.

DESCRIPTION OF EMBODIMENTS

Figure 1:
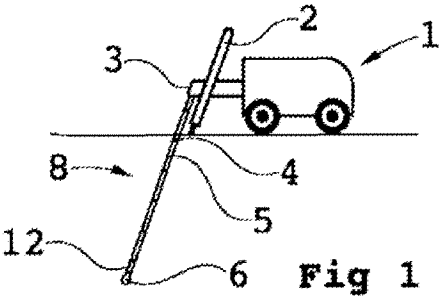
FIG. 1 diagrammatically shows a rock drilling rig and devices according to the invention, FIG. 2 in an axial section shows a first embodiment of a drill bit according to the invention.

In FIG. 1 is shown a rock drilling rig 1 having a feed beam 2 whereon a percussive top hammer rock drilling machine 3 is moveable to-and-fro. The drilling machine 3 produces shock waves as well as rotational torque being transmitted to a drill string 4 in bore hole 1. The drill string 4 is composed of a plurality of drill string components 5, each one including a tube-shaped unit for transmitting rotational force to a drill bit 6 and (not shown) a striker rod for transmitting feed force and shock waves/stress waves to the drill bit 6. The drill bit 6 is most distal on the drill string 4 and is supported by a drill head 12.

Figure 2:
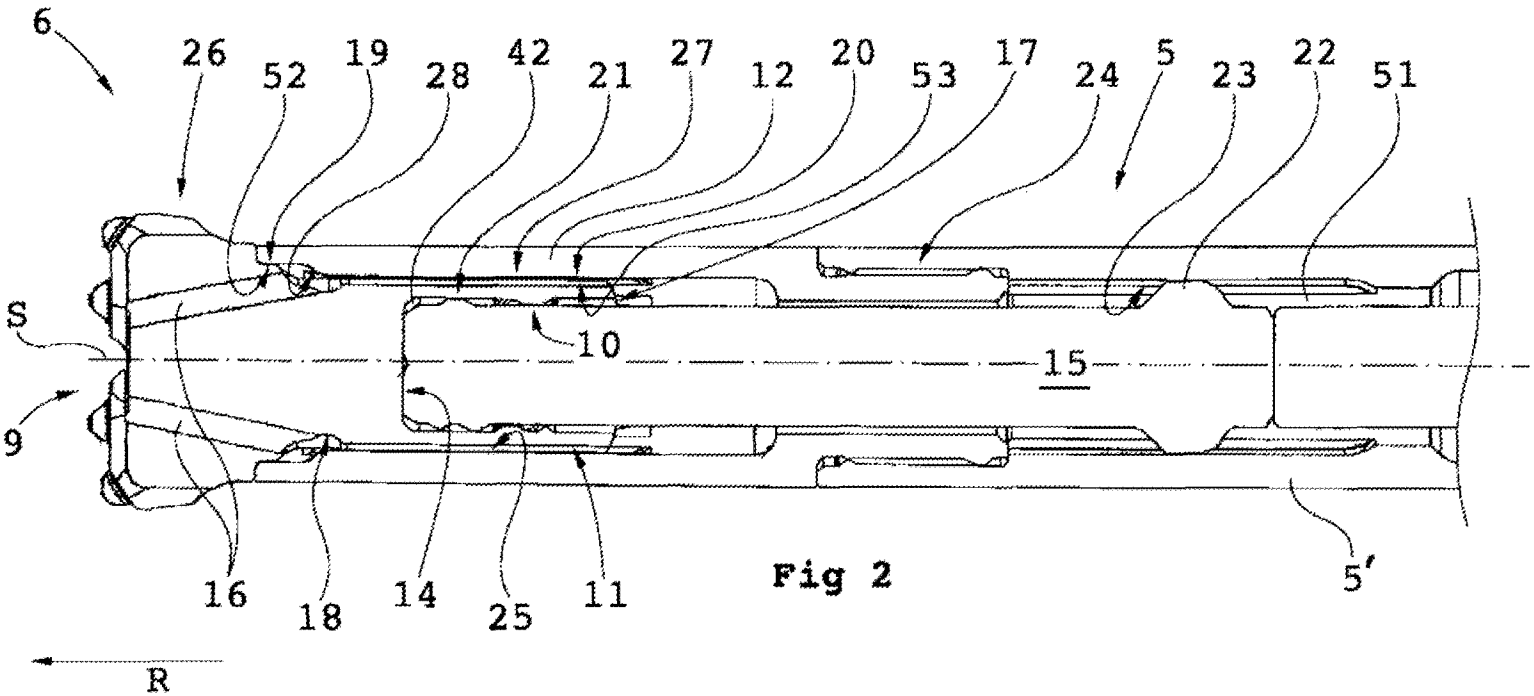

The sectional drawing in FIG. 2 shows the drill bit 6 having an impact portion 26 with an impact surface 9 for delivering strikes forward, against a rock face, which is in an impact direction R. "Backwards" means opposite to the impact direction R, in the direction of the hammer.

The drill bit 6 is supported by and co-operates with a drill head 12 by means firstly of holder means 10 co-operating with holder elements 21 on a striker rod 15, which in turn is held inside a central tubular part 5 of a tube-shaped unit. The drill head 12, a lower threaded end part (not referenced) and the central tubular part 5 form, together with a (not shown) upper threaded end part, a tube-shaped unit of the drill string component 5.

Secondly, the drill bit 6 exhibits rotation engagement means 11 for rotational force co-operation with corresponding means being directed inwards inside a cavity in the drill head 12.

S indicates a symmetry axis around which the drill bit 6 the drill head 12, the striker rod 15 etc are essentially rotational symmetrical. "Axial", "axially" refers to directions along or in parallel with the symmetry axis. "Forward" means in the impact direction along or in parallel with the symmetry axis, whereas "backwards" means opposite to the impact direction R towards the hammer along or in parallel with the symmetry axis. "Radially" means in radial directions in respect of the symmetry axis.

The rotation engagement means 11 are normally splines teeth or ridges that are parallel axially extending ridges divided by grooves so as to form cog-like elements.

The rotation engagement means 11 are directed radially outwards from the pipe-shaped or sleeve-shaped engagement portion for engagement with corresponding elements 25 protruding inwards inside a cavity of the drill head 12.

The holder means 10 are arranged inside and are directed radially inwards inside a holder recess 17 being formed inside the pipe-shaped or sleeve-shaped engagement portion at a rear end of the drill bit 6, which is opening opposite to the impact direction R.

The holder means 10 are in this embodiment shown as a threaded portion extending over a short axial distance (compared to an axial length of the holder recess 17). The threaded portion has a relatively high pitch inside the holder recess 17 for co-operation with corresponding thread (–s) (see numeral 21 on FIG. 5) on the striker rod 15.

Joining the rear part of the drill bit 6 with a front part of the drill head 12 which contacts the drill bit 6 is arranged by positioning the central tubular part 5 on the drill head with the drill bit inside. Thereupon the central tubular part 5' is rotated so as to enter threads 24 between the central tubular part 5' and the drill head whereby the striker rod is simultaneously rotated. Hereby the thread (–s) comprising the holder elements 21 on the striker rod 15 will engage with the thread (–s) comprising the holder means 10 in the holder recess 17.

Figure 5:
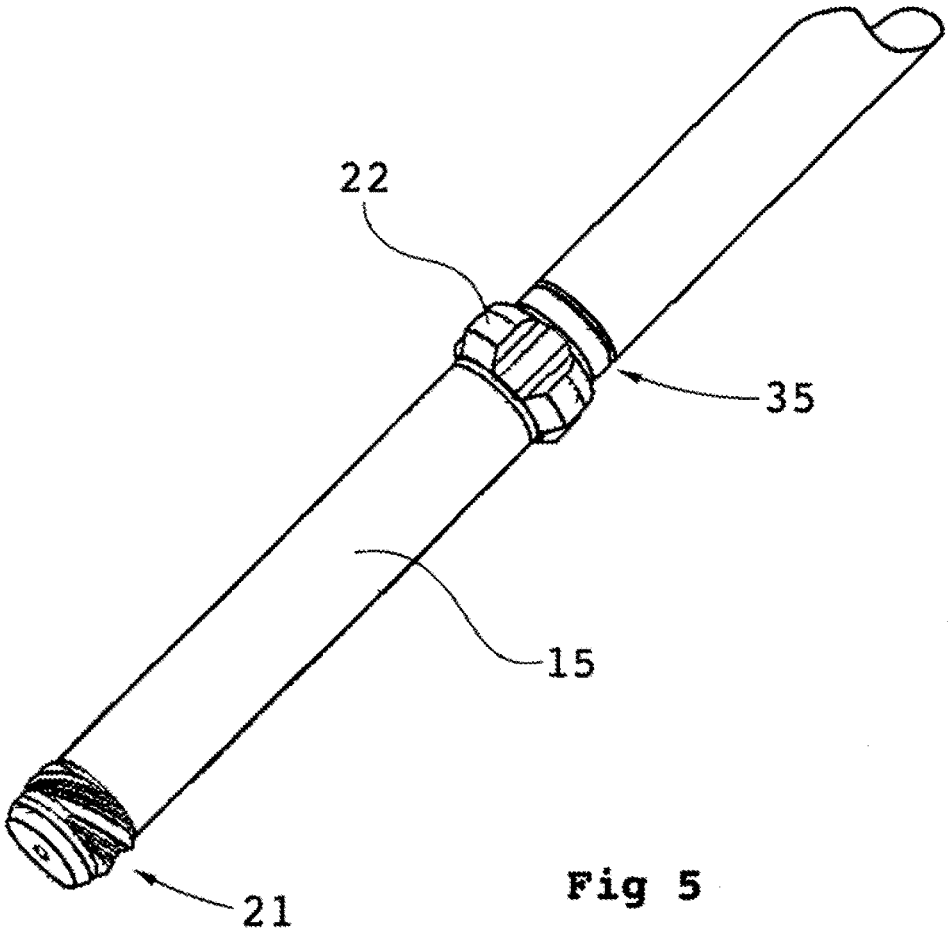
FIG. 5 shows, in a perspective view, a striker rod being part of an inventive drill string component.

Preferably, which is visible on FIG. 5, the thread (–s) comprising the holder elements 21 on the striker rod 15 are multi start threads which means that a plurality of thread ridges and thread grooves comprise the holder elements 21. This ensures fast and more secure entering of these threads when the striker rod is rotated in respect of the drill bit. The thread (–s) comprising the holder means in the holder recess is (are) accordingly adapted but can be comprised of just one single thread ridge.

By having shorter axial thread length and/or higher thread pitch of the threads forming the holder means 10 and the co-operating holder elements 21, it is ensured that the holder means 10 have been threaded through the holder elements 21. This is accomplished by an innermost portion 42 of the holder recess 17 being free from holder means in the form of threads or the like. Hereby the striker rod, after its threads being the holder elements 21 have past the threads being the holder means 10, will be free to move axially in a limited manner relative to the drill hit 6.

This makes it possible for the striker rod 15 to deliver unrestricted shock waves to the anvil surface 14 of the drill hit 6.

The striker rod 15 is rotationally locked in respect of the tubular part 5 because of radially extending wings 22 on the striker rod 15 engaging in axially extending grooves 23 in the tubular part 5.

At an upper part of the tube-shaped unit of the drill string component there is provided a (not shown) conical thread for joining the drill string component 5 with another drill string component. All drill string component threads are formed in a similar way except the end component closest to the drill bit, see above.

Flushing fluid is transmitted from the drill rig through the drill string components 5 all the way to the impact surface 9 inside what is named a flushing channel means.

For that reason flushing fluid flows in a space 51 being formed inside the tubular parts 5' and external of/outside the striker rods 15 of all drill string components (see FIG. 2). In the drill head 12, in the direction of the drill bit 6, flushing fluid passes in a space or spaces external of or outside the engagement portion 27 which includes the holder means as well as the rotation engagement means. This is explained in more detail below.

The flushing fluid will thereby pass through the region of the rotation engagement means 11 in a first section of the flushing channel means and this is for example achieved by ensuring that the grooves formed in the splines connection are radially deepened for providing flushing fluid flow passed this region.

Thereupon the flushing fluid reaches a space defined by a groove 18 and a wall portion 28 of the drill head (see below) in front of the rotation engagement means 11, from where the flushing fluid will enter into a second section of the flushing channel means 16 which is directed from the outside of the drill bit 6 to a more or less central region of the impact surface 9 of the drill bit 6. In the shown embodiment, the second section of the flushing channel means 16 is a number of internal through bores in the impact portion 26.

Figure 3:
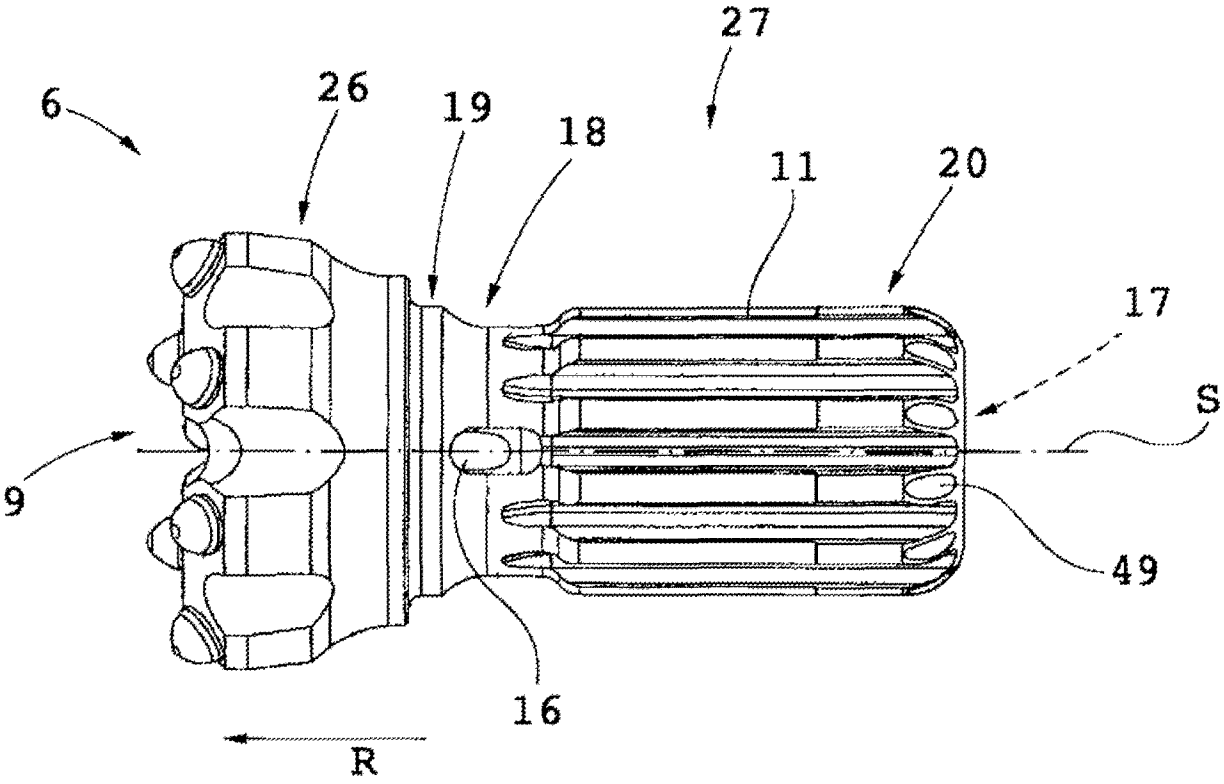
FIG. 3 shows the drill bit in FIG. 2 in a side view.

In FIG. 3 a drill bit according the invention is shown in a side view, wherein is indicated an impact surface 9. A shallow surrounding annular groove 18 extending essentially perpendicular to the symmetry axis S is positioned at an outside of the drill bit, generally between the impact portion 26 and the engagement portion 27. The groove 18 will act as an equalizing and distributing chamber in a mounted position of the drill bit inside a drill head for flushing fluid having passed the rotation engagement means 11 on its way in the impact direction.

From the equalizing and distributing chamber formed by the groove 18 and a wall portion 28 of the drill head (see FIG. 2) the flushing fluid will enter into an inlet opening (or openings) 16' of a bore or bores forming the second section 16 of the flushing channel means. In FIG. 3 is also shown a lower guide area 19 closest to the impact surface 9 and an upper guide area 20 more distant from the impact surface 9.

The lower guide area 19 is a surrounding circular cylindrical surface 19 co-operating with a corresponding surface 52 on the drill head 12 (see FIG. 2) for supporting and guiding the drill bit 6. This also provide for a flushing seal restricting flushing fluid flow through the tight slot formed between the drill bit 6 and the drill head 12 in this region and to prevent rock dust from entering the slot.

The upper guide area 20 is comprised of radially slightly protruding parts of the ridges forming the rotation engagement means 11 so as to form a surrounding, although intermittent, support for co-operation with a corresponding surface portion 53 inside the drill head 12 (see FIG. 2).

At an end surface, facing opposite to the impact direction, of each ridge forming the rotation engagement means 11, a shallow cavity 49 is formed adjacent to and slanting towards the upper guide area 20. The purpose of these cavities 49 is to collect lubricants in the flowing flushing fluid and to deliver collected lubricants to the outside surfaces of the slightly protruding parts for the purpose of enhanced lubrication.

Figure 4:
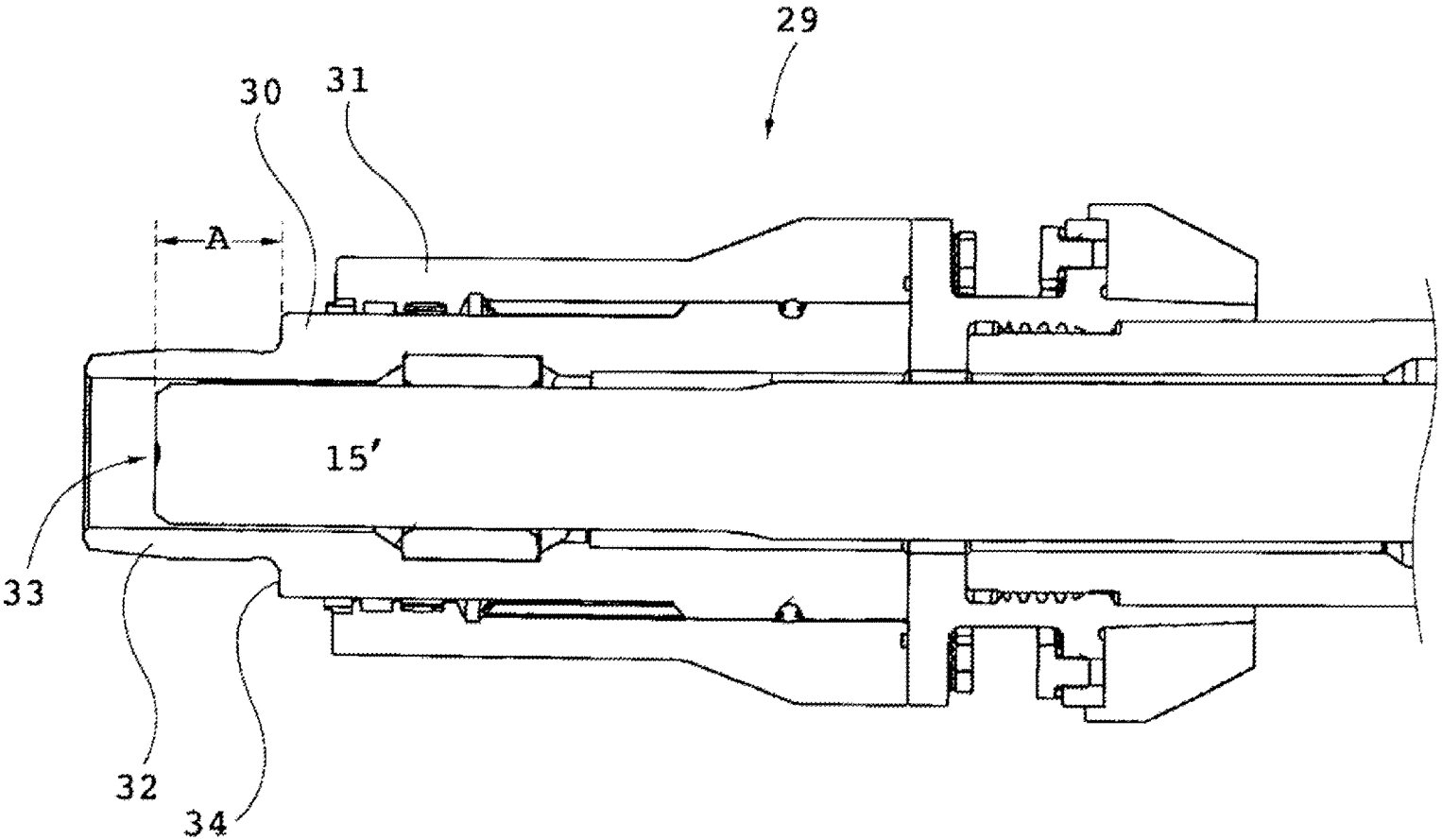
FIG. 4 shows a flex unit for use in a system according to the invention.

In FIG. 4 is shown a tube-formed flex unit 29 including two telescopically displaceable, mutually rotationally locked tubular parts 30 and 31. The tube-formed flex unit 29 allows an axial length compensation for manufacturing tolerances and for shock wave-induced shortenings during operation of striker rods in the drill string relative to tube-shaped units in the drill string over time.

By the tubular parts 30 and 31 being relatively axially displaceable. The distance A between an end surface 33 of striker rod 15' and a contact surface 34 for a drill string component to be joined to the tube-formed flex unit 29 over the thread 32 can vary as required in order to compensate for manufacturing tolerances and shortening of the striker rods of the drill string during operation.

The tube-formed flex unit 29 can be supplemented with a spring-load arrangement (not shown) for distribution of axially directed feed force from the drill rig between the two telescopically displaceable, mutually rotationally locked tubular parts 30 and 31. Such an arrangement is beneficial when drilling in directions that are not vertical downward, because in such directions, forces on the drill string components against the drill bit offered by the influence from gravitation are not producing sufficient contact forces for adequate function.

FIG. 5 shows the striker rod 15 before being positioned in a tube-shaped unit so as to be part of an inventive drill string component. The holder means 10 are arranged at the end of the striker rod 15 to be closest to the drill bit. The radially extending wings 22 on the striker rod 15 being separated by axial grooves for allowing flushing fluid flow and for engaging in axially extending grooves in the tubular part of the tube-shaped unit for preventing relative rotation are also shown in more detail. 35 indicates a friction-weld permanently connecting two rod parts into the completed striker rod.

Figure 6:
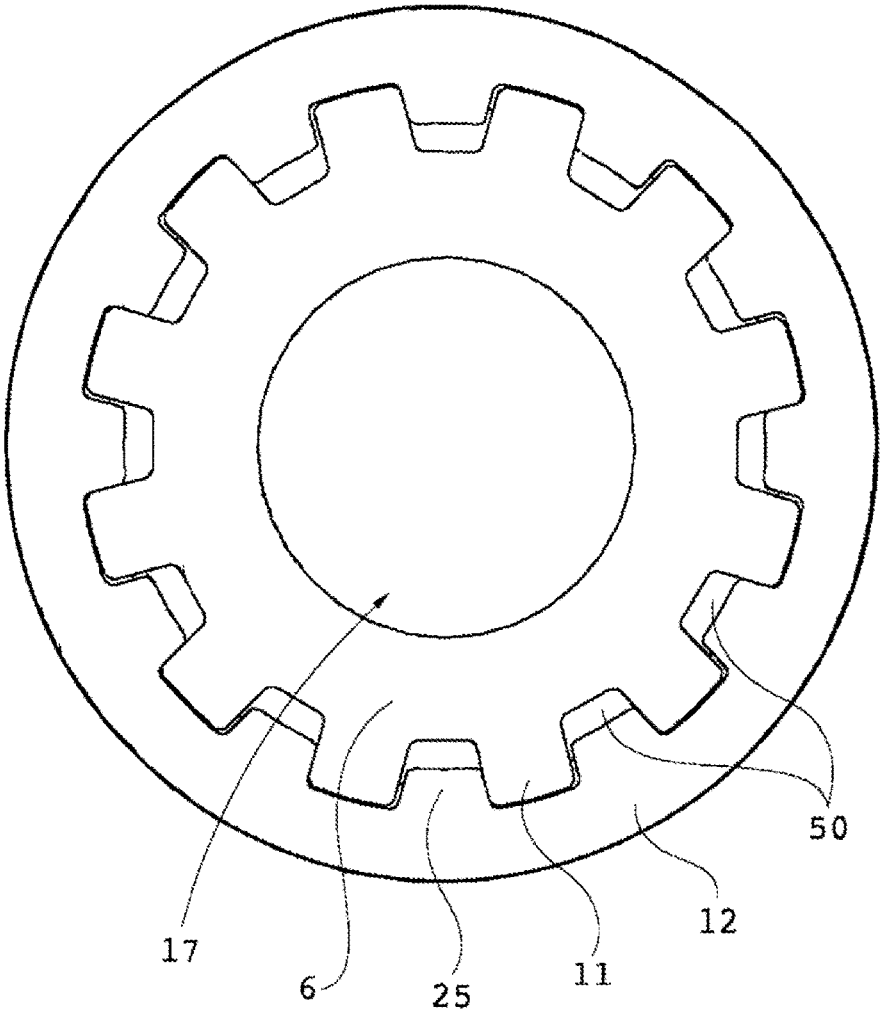
FIG. 6 shows a section through a drill bit inside a drill head.

FIG. 6 shows a cross section through the engagement portion of the drill bit 6 being in connection with the drill head 12. Secondly, the drill bit 6 exhibits rotation engagement means 11 for rotational force co-operation with corresponding means being directed inwards inside a cavity of the drill head 12.

The rotation engagement means 11 in the form of ridges separated by grooves are shown co-operating with corresponding inwards protruding ridge elements 25 at the inside of the drill head 12.

The flushing channel means, in the section shown, being the first section see above), extends in spaces 50 (only two out of twelve are indicated) are formed in the grooves between the plurality of axially extending ridges 11 at the outside of the engagement portion. These grooves are "deepened" which means that they are made deeper than necessary for accommodating the corresponding inward ridge elements 25 formed on the inside of the drill head. The spaces 50 are essentially limited radially outwards by inside surfaces on said inward ridges formed on the inside of the drill head.

Flushing fluid thereby is allowed to flow axially in these spaces 50.

As an alternative, the number of ridges/ridge elements in one of the drill bit and the drill head can be less than the number of grooves in the other one of the drill bit and the drill head, whereby flushing fluid can be allowed to flow in grooves not being occupied by a ridge. As another alternative, grooves between ridge elements 25 can be deepened to form corresponding spaces for fluid flow even if this is not preferred.

Figure 7:
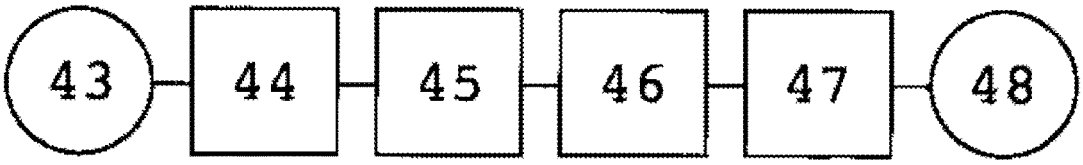
FIG. 7 shows diagrammatically a flow chart depicting a method sequence according to the invention.

An exemplary method sequence for rock drilling is indicated in FIG. 7, wherein:

Position 43 indicates the start of the sequence.

Position 44 indicates subjecting a drill bit to rotation and shock waves/stress waves for delivering strikes against rock in an impact direction.

Position 45 indicates transferring flushing fluid through a drill string in the direction of the drill bit.

Position 46 that flushing fluid is made to flow in a first section of a flushing channel means outside the engagement portion in the region of the rotation engagement means.

Position 47 indicates that the flushing fluid, in a second section, flows from a space outside the drill bit being a flushing fluid equalizing and distributing chamber in a mounted position of the drill bit towards the impact surface.

Position 48 indicates the end of the sequence.

Figure 8:
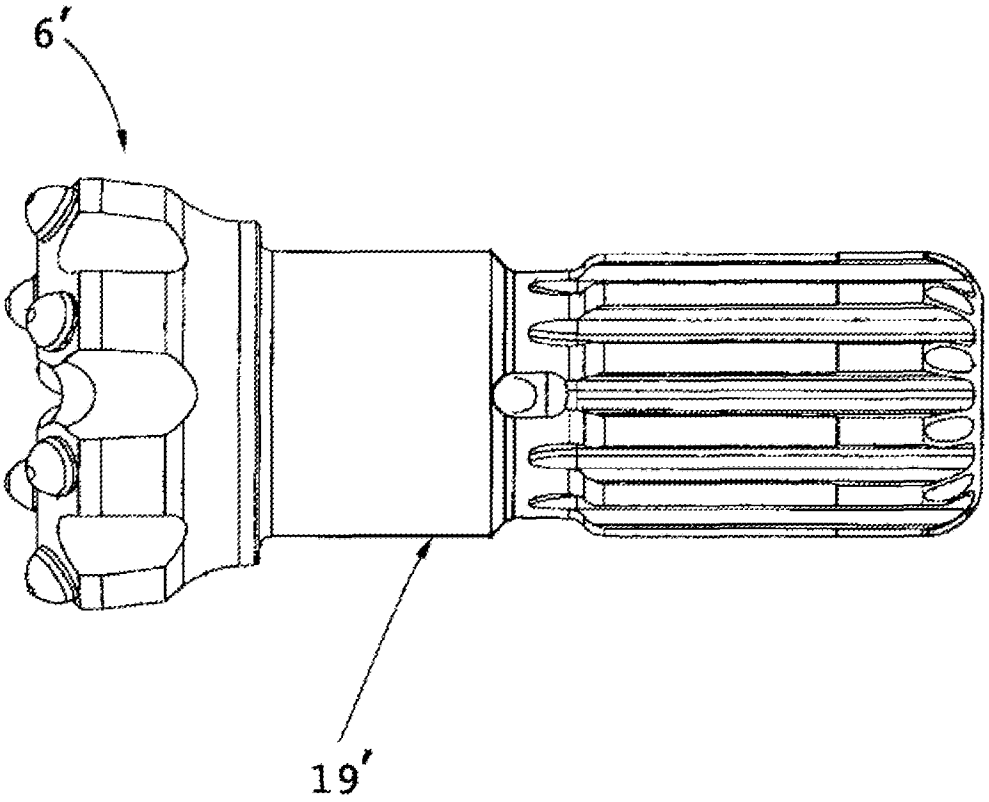
FIG. 8 shows in a side view a drill bit being a variant of the embodiment in FIG. 2.

The invention can be modified within the scope of the claims. It is possible to leave out the tube-formed flex unit 29. In that case it will be necessary to arrange otherwise for compensating the relative shortening of the striker rods. FIG. 8 shows a drill bit 6' having a much longer lower guide area 19' seen axially, which operates in combination with a correspondingly formed longer co-operating corresponding surface (not shown) on the drill head 12. This construction makes it possible to allow a continuous variation of total striker rod lengths for the entire drill string and let the variation be accepted through a corresponding continuous variation of the relative axial position between the drill head and the drill bit.

Other variants of different elements are covered by the claims.

The splines coupling in the rotation engagement means can be with helical splines, having a certain (high) pitch. This has the benefit that rotation of the drill head adds a certain axial force opposite to the impact direction to the drill bit.

The invention claimed is:

1. A drill bit for top hammer percussion rock drilling including:

an impact portion with an impact surface for striking against rock in an impact direction, an engagement portion comprising a holder configured to hold the drill bit axially in a drill head of a drill string, a rotation engagement member configured to connect the drill bit with the drill head for the purpose of rotation of the drill bit, and a holder recess having an opening that is directed opposite to the impact direction, wherein the holder is arranged inside the holder recess, an anvil surface being directed opposite to the impact direction for receiving shock waves from a striker rod of the drill string, wherein the holder is directed inwards inside the holder recess for co-operation with corresponding holder elements on the striker rod, wherein the anvil surface is arranged inside the holder recess, and wherein the rotation engagement member is directed outwards for rotational force co-operation with corresponding elements protruding inwards inside a cavity of the drill head.

2. The drill bit according to claim 1, wherein the anvil surface is a bottom surface inside the holder recess.

3. The drill bit according to claim 1, wherein the holder is positioned so as to allow limited axial movement of the drill bit with respect to the drill head.

4. The drill bit according to claim 1, wherein the holder comprises female screw threads and the holder comprises male screw threads configured to cooperate with the female screw threads.

5. The drill bit according to claim 1, wherein the holder recess has an innermost portion free from the holder.

6. The drill bit according to claim 1, further comprising:

a flushing channel configured to direct a flow of flushing fluid to the impact surface, wherein the flushing channel comprises a first section and a second section, wherein in the first section, the flushing channel extends outside the engagement portion, and wherein in the second section, the flushing channel extends from the engagement portion to a central region of the impact surface, whereby, in operation of the drill bit, the flushing fluid is arranged to flow between surfaces limiting the drill bit in said first section and adjacent surfaces limiting the drill head.

7. The drill bit according to claim 6, wherein the flushing channel, in the second section, extends from a flushing fluid equalizing and distributing chamber outside the drill bit in a mounted position of the drill bit towards the impact surface.

8. The drill bit according to claim 1, further comprising:

axially separated upper and a lower guide areas for co-operation with the drill head.

9. The drill bit according to claim 8, further comprising:

a shallow cavity adjacent to and slanting radially outward toward the upper guide area at an end surface, facing opposite to the impact direction, of each one of a plurality of ridges forming the rotation engagement member in order to collect lubricants in the flowing flushing fluid and to deliver collected lubricants to outside surfaces of the upper guide area.

10. The drill bit according to claim 1, wherein the rotation engagement comprises axially extending ridges or helically extending ridges.

11. A drill string component for positioning between a percussive rock drilling machine and a drill bit, the drill string component including:

a tube-shaped, rotation force transmitting unit having screw threads at each end for joining to other drill string components, and a striker rod for transmitting feed force and shock waves to the drill bit and being coaxial with and extending inside the tube-shaped unit, wherein a flushing fluid flow channel is formed inside the tube-shaped unit, and wherein the tube-shaped unit includes rotational co-operation members configured to rotationally cooperate with rotation engagement elements of the striker rod.

12. The drill string component according to claim 11, wherein the rotational cooperation elements comprise a combination of axially extending inward ridges and grooves.

13. The drill string component according to claim 11, wherein the rotation engagement elements of the striker rod comprise radially extending wings.

14. The drill string component according to claim 11, wherein the flushing fluid flow channel is formed between the tube-shaped unit and the striker rod.

15. The drill string component according to claim 11, further comprising:

a drill head for holding the drill bit, wherein an end part of the drill head facing away from the drill bit comprises a thread configured to permit the drill head to be threaded together with an end part of the tube-shaped unit.

16. The drill string component according to claim 15, wherein the drill head is dimensioned in relation to the drill bit such that a striker rod being part of the drill string component is directly used for action against the anvil surface of the drill bit.

17. The drill string component according to claim 11, wherein the striker rod comprises outwardly directed holder elements.

18. The drill string component according to claim 17, wherein the holder elements comprise male screw threads configured to cooperate with female screw threads on the drill bit.

19. A drill string system for percussion rock drilling, the drill string system comprising:

a drill bit comprising an impact portion comprising an impact surface for striking against rock in an impact direction, an engagement portion comprising a holder configured to hold the drill bit axially in a drill head of a drill string, a rotation engagement member configured to connect the drill bit with the drill head for the purpose of rotation of the drill bit, and a holder recess having an opening that is directed opposite to the impact direction, wherein the holder is arranged inside the holder recess, an anvil surface being directed opposite to the impact direction for receiving shock waves from a striker rod of the drill string, wherein the holder is directed inwards inside the holder recess for co-operation with corresponding holder elements on the striker rod, wherein the anvil surface is arranged inside the holder recess, and wherein the rotation engagement member is directed outwards for rotational force co-operation with corresponding elements protruding inwards inside a cavity of the drill head.

20. The drill string system according to claim 19, further comprising:

flushing fluid flow channels formed between the drill bit and the drill head in the region of the rotation engagement member.

21. A drill string system for percussion rock drilling, the drill string system comprising:

at least one drill string component comprising a tube-shaped, rotation force transmitting unit having screw threads at each end for joining to other drill string components, and a striker rod for transmitting feed force and shock waves to the drill bit and being coaxial with and extending inside the tube-shaped unit, wherein a flushing fluid flow channel is formed inside the tube-shaped unit, and wherein the tube-shaped unit includes rotational co-operation members configured to rotationally cooperate with rotation engagement elements of the striker rod.

22. The drill string system according to claim 21, further comprising:

a drill bit comprising an impact portion comprising an impact surface for striking against rock in an impact direction, an engagement portion comprising a holder configured to hold the drill bit axially in a drill head of a drill string, a rotation engagement member configured to connect the drill bit with the drill head for the purpose of rotation of the drill bit, and a holder recess having an opening that is directed opposite to the impact direction, wherein the holder is arranged inside the holder recess, an anvil surface being directed opposite to the impact direction for receiving shock waves from a striker rod of the drill string, wherein the holder is directed inwards inside the holder recess for co-operation with corresponding holder elements on the striker rod, wherein the anvil surface is arranged inside the holder recess, and wherein the rotation engagement member is directed outwards for rotational force co-operation with corresponding elements protruding inwards inside a cavity of the drill head.

23. The drill string system according to claim 21, further comprising:

a tube-formed flex unit including two telescopically displaceable, mutually rotationally locked parts allowing an axial length compensation for shock wave-induced shortenings of striker rods in the drill string relative to tube-shaped units in the drill string over time.

24. The drill string system to claim 19, wherein a sum of a length of the drill bit from the impact surface to the anvil surface and a length of a striker rod being in contact with the drill bit is 300-2000 mm.

25. A method for rock drilling, the method comprising:

striking in an impact direction against rock an impact surface of a drill bit, wherein in an engagement portion the drill bit comprises rotation engagement member configured to cooperate with a drill head, and transferring flushing fluid through a drill string to the impact surface, wherein the flushing fluid flows in a first section of a flushing channel outside the engagement portion in the region of the rotation engagement member, and wherein the flushing fluid, in a second section, flows from a space outside the drill bit, wherein the space comprises a flushing fluid equalizing and distributing chamber in a mounted position of the drill bit towards the impact surface.

26. The drill string system according to claim 24, wherein the sum of the length of the drill bit from the impact surface to the anvil surface and the length of the striker rod being in contact with the drill bit is 700-900 mm.

* * * * *